US005653046A

United States Patent [19]

Lawlor

[11] Patent Number: 5,653,046

[45] Date of Patent: Aug. 5, 1997

[54] DURABLE, LIGHTWEIGHT SHOCK RESISTANT SHOE SOLE

[76] Inventor: Kevin B. Lawlor, 493 Arborway, Jamaica Plain, Mass. 02130

[21] Appl. No.: 524,035

[22] Filed: Sep. 6, 1995

[51] Int. Cl.[6] ..... A43B 13/20; A43B 13/12

[52] U.S. Cl. ..... 36/28; 36/25 R; 36/114; 36/59 C

[58] Field of Search ..... 36/28, 32 R, 30 R, 36/102, 59 C, 25 R, 129, 29, 114, 7.8

[56] References Cited

U.S. PATENT DOCUMENTS

| | | | |
|---|---|---|---|
| D. 248,127 | 6/1978 | Batra . | |
| D. 255,175 | 6/1980 | Iwakata . | |
| D. 267,288 | 12/1982 | Davis | 36/28 |
| 1,352,731 | 9/1920 | Egerton . | |
| 2,424,463 | 7/1947 | Hogg . | |
| 3,086,532 | 4/1963 | Mistarz | 36/32 R |
| 3,568,340 | 3/1971 | Gardner | 36/32 R |
| 3,918,181 | 11/1975 | Inohara . | |
| 4,096,649 | 6/1978 | Saurwein . | |
| 4,266,349 | 5/1981 | Schmohl | 36/32 R |
| 4,697,361 | 10/1987 | Ganter | 36/28 |
| 4,878,300 | 11/1989 | Bogaty | 36/28 |
| 4,944,321 | 7/1990 | Lawlor | 36/28 |
| 5,280,680 | 1/1994 | Burke et al. | 36/28 |

OTHER PUBLICATIONS

The Running Shoe Book, Peter R. Cavanagh.

*Primary Examiner*—M. D. Patterson
*Attorney, Agent, or Firm*—Jerry Cohen; Jacob N. Erlich

[57] ABSTRACT

A durable, lightweight shock absorbing shoe sole having an upper sole and a bottom sole attached to the bottom of the upper sole and including a plurality of inverted cups within the bottom sole and penetrating into the upper sole. At least one of the inverted cups being of a preselected configuration and located directly beneath and pointed convexly toward a natural contact point of the human foot for absorbing and dispersing shock generated at the natural contact point during a footstep. The cup is also angularly displaced with respect to the longitudinal axis of the sole a preselected number of degrees with respect to the longitudinal axis. In addition, a reinforcing system is incoporated within the shoe sole and works in cooperative relationship with the inverted cups for increasing the structural integrity of the shoe sole.

12 Claims, 12 Drawing Sheets

DURABLE, LIGHTWEIGHT SHOCK RESISTANT SHOE SOLE

FIELD OF THE INVENTION

The present invention relates generally to an improved shock resistant shoe sole which is particularly appropriate for use in running shoes, sneakers and other athletic and nonathletic footwear.

BACKGROUND OF THE INVENTION

During intense athletic activities such as those which involve sprinting, jogging and other forms of running tremendous impact forces are experienced by the foot as it bears the entire burden of the athlete's weight each time it encounters the ground. In the sport of long distance running, in particular, such impact shock upon the foot may over a prolonged period, cause repeated number of injuries to the bones, muscles, joints, ligaments and tendons of the foot and leg. Recently, because of increased interest in physical fitness, and running in particular, the problem of foot and leg injuries has become acute and widespread. Remedies have focused upon more effective warm-up (e.g. calisthenics) techniques and improved equipment (e.g. running and other athletic shoe) design. Stress injuries to feet and legs persist, however.

The midsole or upper sole presently employed by the typical athletic shoe does not exhibit both optimal shock resistance and stability control. As the midsole is made of a softer material, (e.g. foam), its shock absorbent qualities are enhanced but stability and control are lost. This occurs because a certain proportion of the impact shock is transmitted up the bone structure to the ankle, causing it to wobble. Harder materials, (e.g. rubber), are more stable (less shock transmitted to the ankle), but result in more of the impact shock being absorbed directly by the foot.

The present invention has overcome the basic shortcomings of the prior art by providing an improved durable, lightweight shock resistant shoe sole which utilizes one or more inverted cups dispersed within the outersole or bottom sole which has its cup-shaped cavity penetrate the upper or midsole sole to such a degree that the upper sole plays essentially no part in absorbing shock at the natural contact point during a footstep. Such a shoe sole is an enhanced version of the shoe sole described by the inventor in U.S. Pat. No. 4,494,321.

It is an object of this invention to provide a high-strength shoe sole which incorporates therein impact absorbing inverted shock cups of a variety of shapes and configurations in order to maximize usage of the soles.

It is a further object of this invention to provide a high-strength shoe sole which provides impact absorbing inverted cups in a variety of locations within the sole to increase its effectiveness in absorbing shock and decrease its weight.

It is still another object of this invention to provide a high-strength shoe sole which provides impact absorbing inverted cups at a variety of preselected orientations with respect to the axis of the foot to increase its effectiveness in absorbing shock.

It is even a further object of this invention to provide a high-strength shoe sole which provides impact absorbing inverted cups having reinforcing means associated therewith to increase the durability thereof.

It is still a further object of this invention to provide a high-strength shoe sole which provides visibility of the impact absorbing inverted cups while adding structural support thereto.

SUMMARY OF THE INVENTION

The present invention increases the effectiveness of the shock resistant shoe sole described in the inventor's U.S. Pat. No. 4,494,321.

As in the above-identified patent, this invention results from a realization that during a walking or running footstep the foot makes impact with the ground at a number of natural contact points. Typically, three such points are exhibited: the calcaneum or heel bone and the first and fifth metatarsals.

An effective manner of absorbing impact shock experienced during running or walking should involve dispersing and mollifying the shock of each of these contact points in an optimal manner. This invention describes an effective means of shock absorption and dispersion by utilizing arch or inverted cup-like structures where impact shock is transmitted down the sides of the structure for dispersal therefrom. More specifically, it features a shock absorbent shoe sole which includes an upper or midsole and a bottom sole attached to the bottom of the upper sole and one or inverted cups disposed therein.

Although the concept set forth in U.S. Pat. No. 4,494,321 is still sound, the present invention further enhances the shock absorbing capability of the cups. For example, the improvements of the present invention strengthen the structural integrity of the inverted cups and provide for the possibility of a wide variety of configurations. This enables the sole of the shoe to be used for a wider range of sports and other footwear related activities.

A further improvement of this invention incorporates the use of a mesh net, belt or string made of silicone or fiberglass thread or other such material wrapped around and embedded in the inverted cup or alternatively placed over the cups. This would reinforce the cup shape and structural integrity and therefore make possible a wider variety of cup shapes.

In one embodiment of the invention this net is extended outside the region of the cups. In another embodiment of the invention the net connects the inverted cups to each other. This not only absorbs shock but also reinforces each cup structure and stability. Other string-like elements are connected to these strings in a crosswise configuration from the medial to the lateral side throughout the length of the sole. Inside the inverted cup area these crosswise strings would distribute the shock out the sides. Two sets of net strings could be embedded in the outsole or bottom sole and or placed over the outsole in between the midsole and outsole.

Further improvements of the present invention pertain to the orientation of the inverted cups in the shoe sole as well as the shape of the cups. These improvements would make the sole more compatible with different sports and footwear related activities. The different orientation of the rearfoot cup locates it in a more parallel orientation to the sides and down the centerline of the last in the rearfoot area. Runners place enormous weight on the more lateral side of the rearfoot and midfoot with each footstrike. This improved shift in orientation of the rearfoot cup makes it more compatible with the orientation of the mesh net, mentioned above, as it extends out from the front part of the rearfoot cup.

The present invention's utilization of different shapes of inverted cups in different places make the sole more compatible with specialized sports activities. For example, round cups provide Good shock absorption for aerobic athletes, which have an up and down movement to their foot. More rounded cups also fit a sport like tennis that employs a more lateral to medial foot motion. Basketball would require a specialized cup shape and orientation as well.

Another improvement of the present invention includes a long narrow cup along the lateral border of the outsole. This would be particularly helpful for runners who exert strong lateral forces on a shoe sole. This cup would be in a banana-like shape and proceed from the rearfoot to the forefoot cups. This shape of the inverted banana-like cup would then proceed out toward the lateral edge and up this edge of the foot towards the baby toe. It would turn in towards the medial side as it headed through the midfoot area. The improved orientation of the inverted cups, the new banana-shaped cups, the string mesh net outside the cups all enhance shock absorption.

A further embodiment of this invention includes a reinforcing means in the form of a transparent doughnut-like window encapsulated in the inverted cups to also allow a consumer to see the sides of the cups as well as the bottom. This doughnut shape provides additional structural support for the inverted cups. Color coordinating the cups and mesh net strings would add to the attractiveness of the shock resistant sole of this invention.

For a better understanding of the present invention, together with other and further objects, reference is made to the following description taken in conjunction with the accompanying drawings, and its scope will be pointed out in the appended claims.

DETAILED DESCRIPTION OF THE PREFERRED EMBODIMENTS

The durable shock resistant shoe sole of the present invention is an enhanced version of the inventor's shock resistant shoe sole of U.S. Pat. No. 4,494,321. Consequently, certain elements described in the present invention are also shown and described in U.S. Pat. No. 4,494,321. The details of those similar components will not be explained in as great a detail in the present invention.

More specifically, the present invention encompasses a rubber bottom sole or outsole which is attached to the bottom of a dense foam upper midsole or upper sole made of a conventional material such as polyurethane or EVA by glue, epoxy, or other conventional means of the shoe making art. An inner sole may be similarly attached to the top of the midsole or upper sole. Furthermore, an upper shoe portion is thereafter attached to the shoe sole by any conventional means. As with the inventor's previously identified shock resistant shoe sole, inverted shock cups are disposed within the bottom sole or outsole and pass into or through the midsole to absorb a substantial amount of shock during use of the shoe. The bottom surface of the bottom or outsole is shown as primarily flat, however, ribs or other patterns for enhancing gripping contact between the shoe sole and the ground may also be provided on the bottom surface of the outsole. Although a left sole is illustrated in a number of the figures of the present invention it should be understood that identical structure and function is exhibited by a right shoe sole also made in accordance with the present invention.

Figure 1:
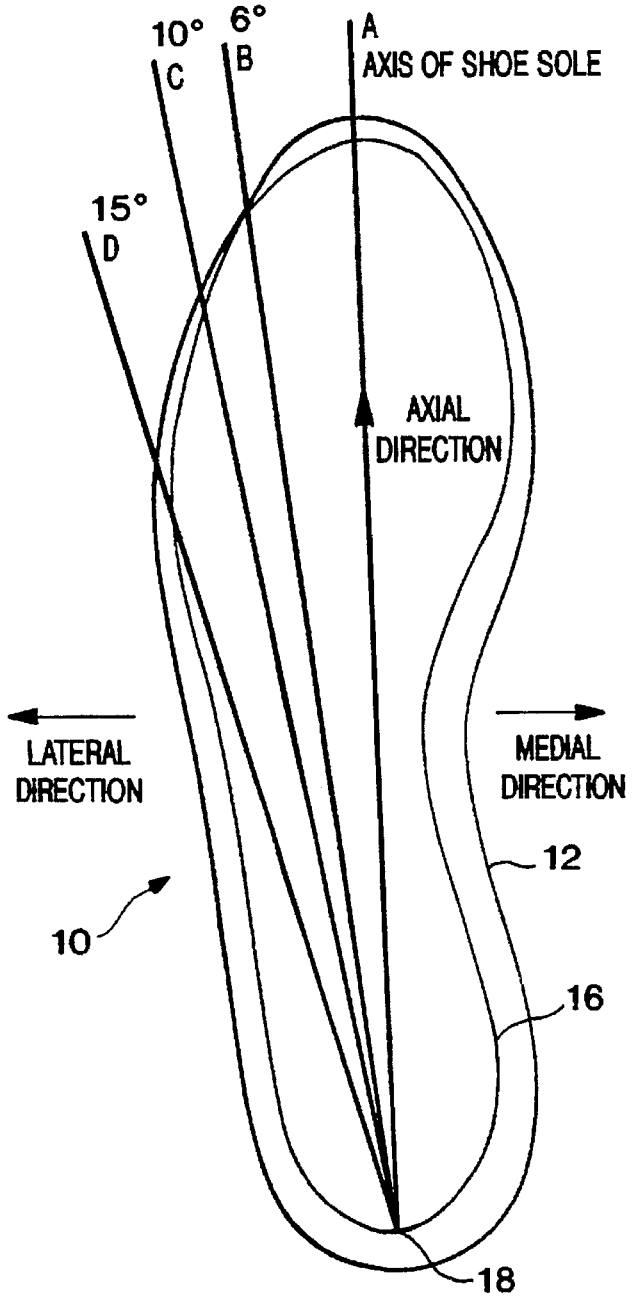
FIG. 1 is a top plan view of the midsole or upper sole of the durable shock resistant shoe sole of this invention illustrating the last bottom and axis of the sole.
Figure 2:
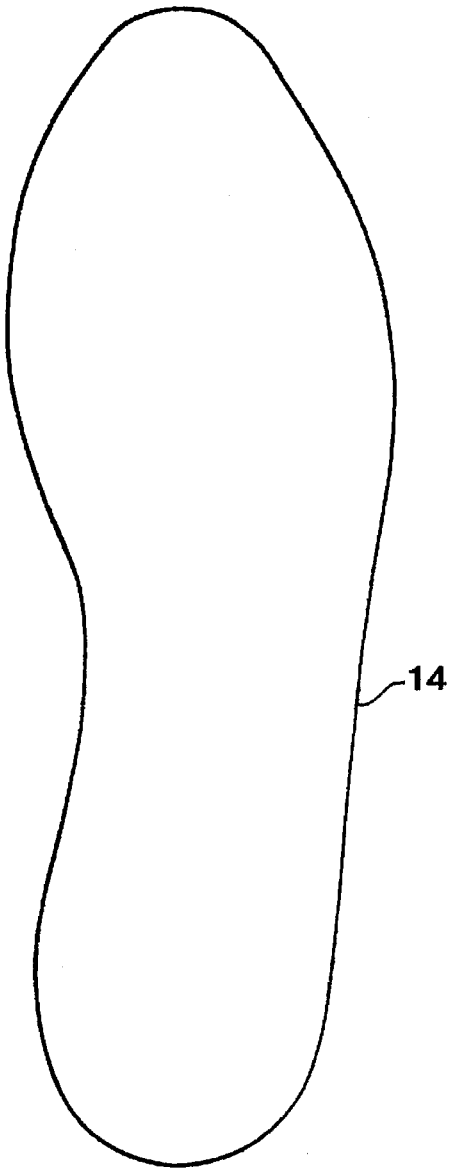
FIG. 2 is a bottom plan view of the outsole or bottom sole of the durable shock resistant shoe sole of FIG. 1.

Reference is now made to FIG. 1 of the drawings which illustrates a top view of the upper sole or midsole 12 of the shoe sole 10 of this invention. FIG. 2 represents a bottom view of the outsole or bottom sole 14. Also illustrated in the top view of FIG. 1 is the outline shape of the last bottom 16.

In order to understand the concept involved in the present invention, the axis A of the sole 10 is illustrated in FIG. 1. Axis A runs longitudinally substantially through the mid point of the shoe sole with its back point being the back point 18 of he last bottom 16, a term of art used in the shoe making industry. From this back point 18 various rays or lines B, C and D are drawn representing a number of different degrees of departure from the axis A of the sole 10. For example, line B is representative of a 6 degree positioning from axis A in the outside medial or lateral direction, while line C represents a 10° departure and line D represents a 15° departure from axis A. It should be further recognized, although not shown, that depending upon the positioning of the axis A of sole 10 lines of departure can also run in the medial direction of the shoe sole as well. These lines form part of FIG. 1 for illustration only in order to better understand the various embodiments of this invention, all of which will be described in greater detail hereinbelow. With respect to the various embodiments illustrated in the drawings and described in the specification, similar components will be depicted with identical numerals for clarity and ease of understanding of the present invention.

Figure 3:
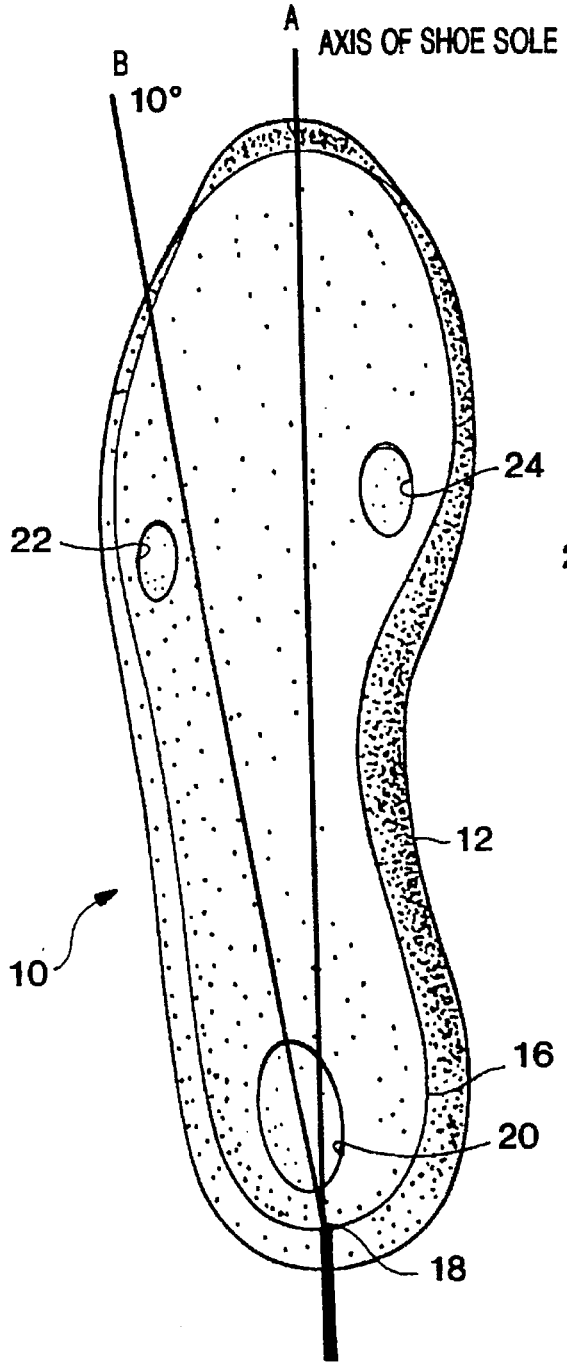
FIG. 3 is a top plan view of the midsole or upper sole of the durable shock resistant shoe sole of this invention depicting an angularly aligned shock cup of one embodiment of this invention.
Figure 4:
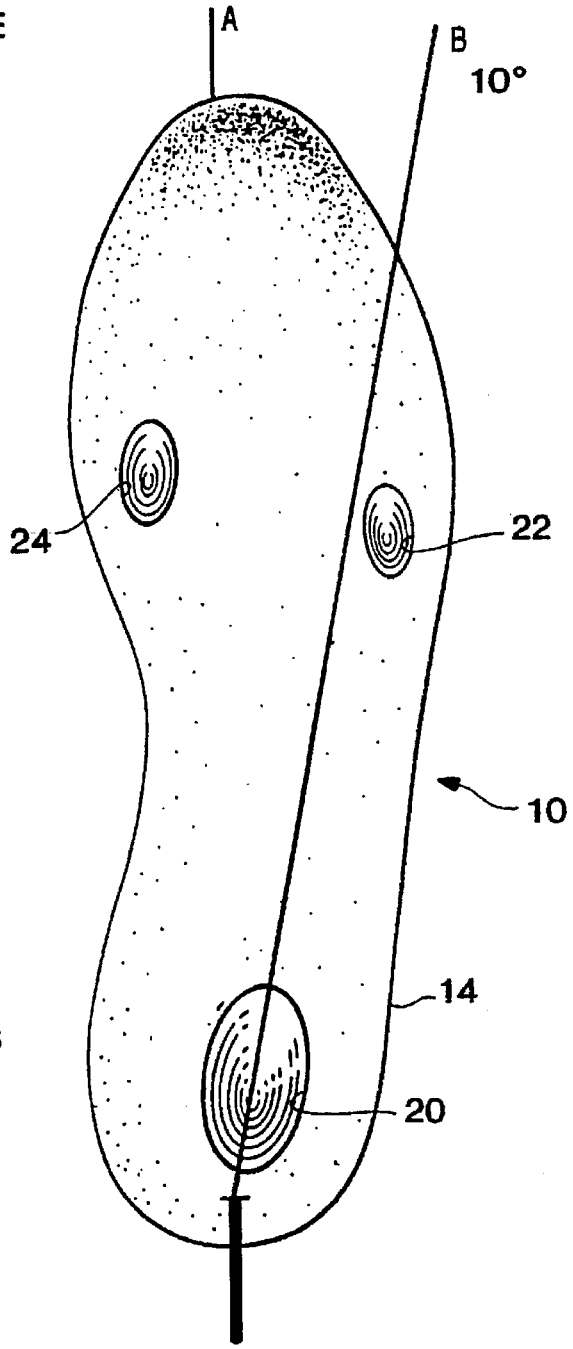
FIG. 4 is a bottom plan view of the outsole of the durable shock resistant shoe sole of FIG. 3.

FIGS. 3 and 4 of the drawings depict an embodiment of the present invention which incorporates therein a plurality (preferably three in number of elliptically-shaped shock cups 20, 22, and 24. Since the human foot typically includes three (3) natural contact points which include the calcaneum or heel bone and the first and fifth metatarsals, during a foot step or runners stride, first the heel bone and then the metatarsals will encounter (e.g., make natural contact with) the ground (through, of course, the sole 10). These natural contact points bear the impact shock of each step taken. As the running activity becomes more strenuous or prolonged, such impact shock is amplified.

The inventor's prior patent, in U.S. Pat. No. 4,494,321 provides a detailed description of shock cups which are utilized to obviate the shock which is encountered by these three contact points on the foot. One embodiment of the present invention replaces the shock cups of the previous-identified patent with elliptically formed shock cups 20, 22 and 24 at three selected angles with respect to the axis A of the sole 10. For example, as shown in FIGS. 3 and 4 of the drawings a 10° rotation of the elliptical shock cup 20 along line B with respect to axis A substantially increases the effectiveness of absorbing the shock which is encountered during the foot step or runners stride.

Although 10° is considered an optimum angle of departure from the axis A of the sole 10 for runners, these angles of departure may vary between 6° and 15° depending upon the size of the foot as well as the type of activity pursued by the wearer of the shoe. Although the angle of departure is generally toward the lateral direction as shown in FIG. 1 of the drawings, it is also possible, under certain circumstances, when the size or shape of the shoe dictates the angle of departure from axis A of the shoe 10 can also be in the medial direction. In addition, the forefoot shock cups 22 and 24 are also rotated approximately 5° to 7° in order to assist in the shock absorbing characteristics of the shock cups. It should also be noted that the placement of these elliptical shock cups 22 and 24 may vary along the lateral axis to accommodate different sized feet or widths.

Figure 5:
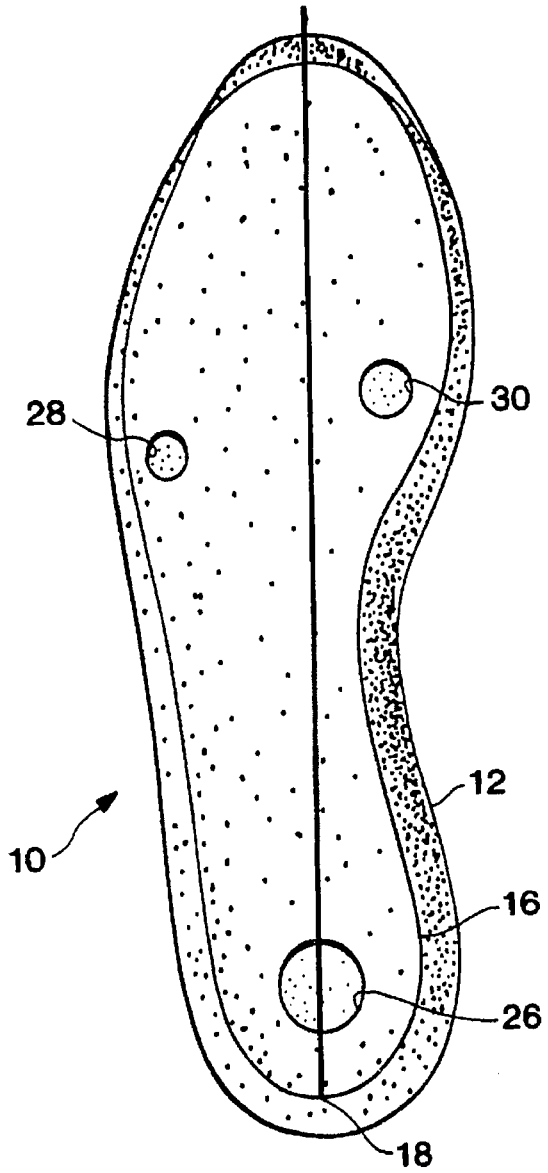
FIG. 5 is a top plan view of the midsole or upper sole of the durable shock resistant shoe sole depicting an alternatively shaped shock cup of another embodiment of this invention.
Figure 6:
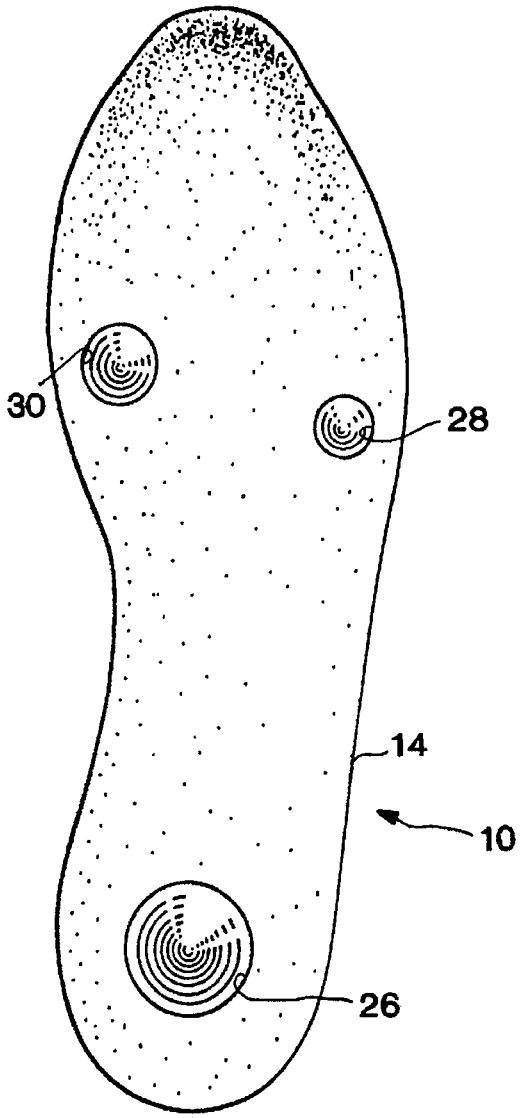
FIG. 6 is a bottom plan view of the outsole of the durable shock resistant shoe sole of FIG. 5.

The embodiment of this invention illustrated in FIGS. 5 and 6 of the drawings depict a plurality of shock cups 26, 28 and 30 which are circular in their planar configuration in order to accommodate a particular type of shoe. For example, an aerobic shoe or a tennis shoe which does not rely upon high impact at its lateral edges find the circular configuration to be the most effective in absorbing shock at the three points of contact. The rear shock cup 26 is therefore centrally located along the axis A while the forefoot shock pads 28 and 30 are located along a lateral line so as to contact directly beneath the first and fifth metatarsals of the foot.

Figure 7:
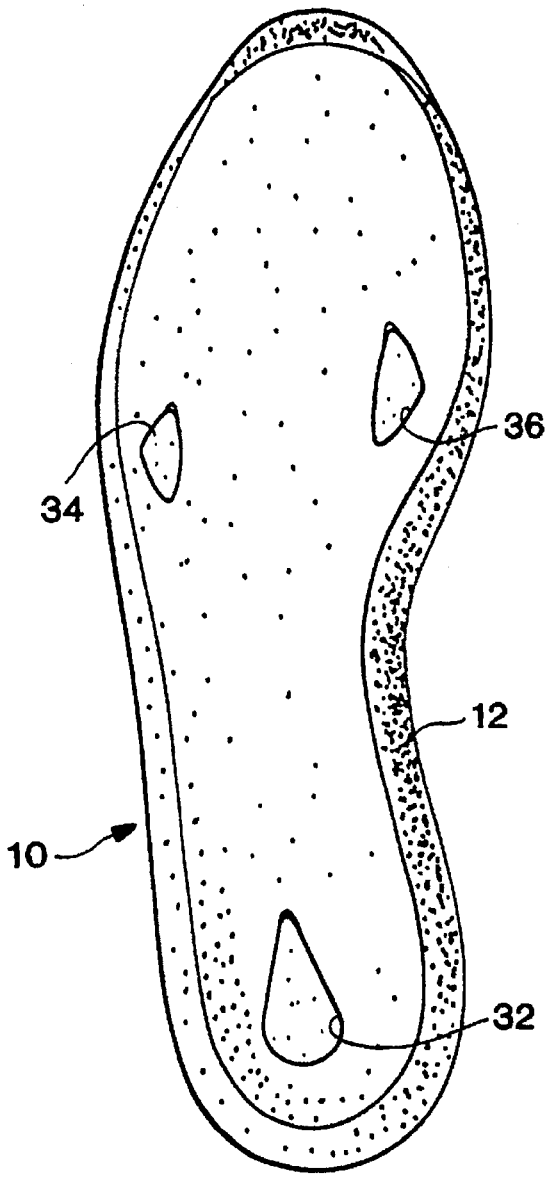
FIG. 7 is a top plan view of the durable shock resistant shoe sole depicting an alternately shaped shock cup of a further embodiment of this invention.
Figure 8:
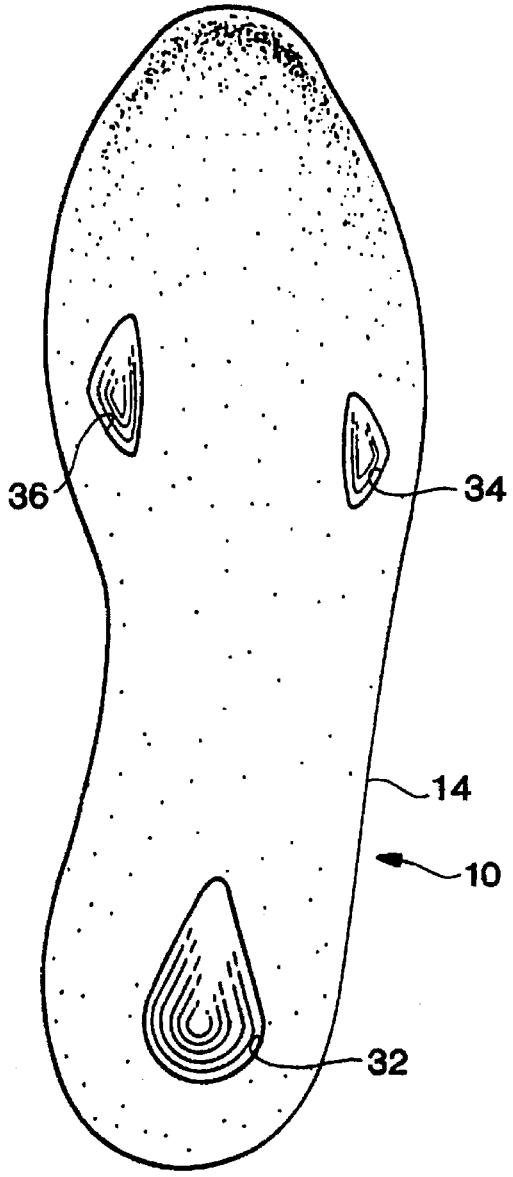
FIG. 8 is a bottom plan view of the outsole of the durable shock resistant shoe sole of FIG. 7.

A further embodiment o the present invention is depicted in FIGS. 7 and 8 of the drawings where teardrop configured shock cups 32, 34 and 36 are utilized to accommodate such sports as basketball which confront the pressures on the contact points somewhat intermediate the pressures associated with running, tennis or aerobic sports. Likewise, as shown in FIGS. 3 and 4 of the drawings these teardrop shaped shock cups are angled with respect to the axis A of the shoe sole 10.

Figure 9:
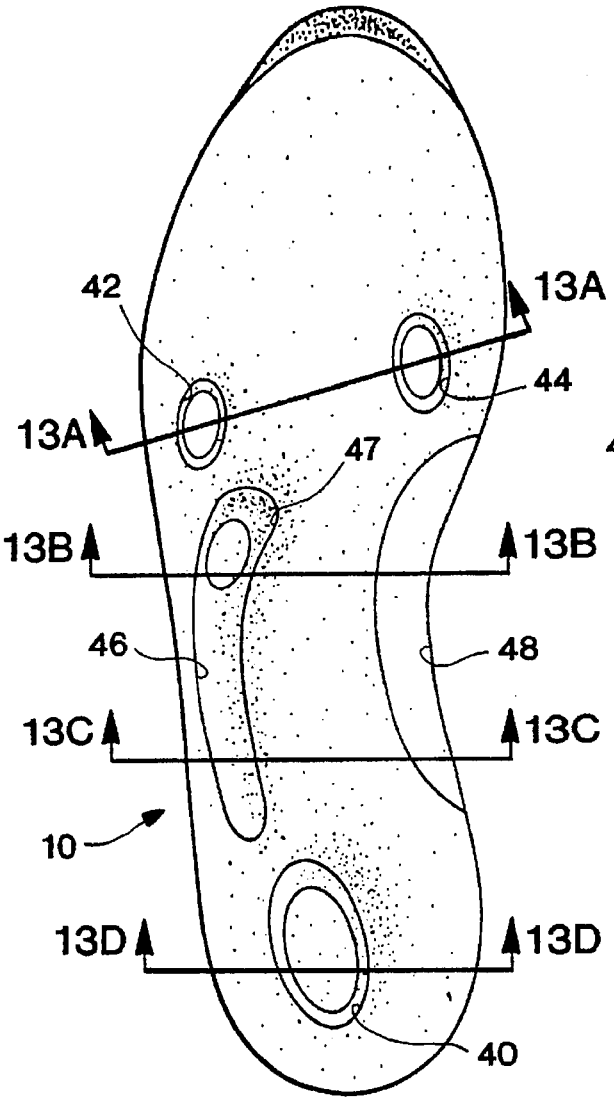
FIG. 9 is a top plan view of the outsole of the durable shock resistant shoe sole depicting a variety of shock cups in still a further embodiment of this invention.
Figure 10:
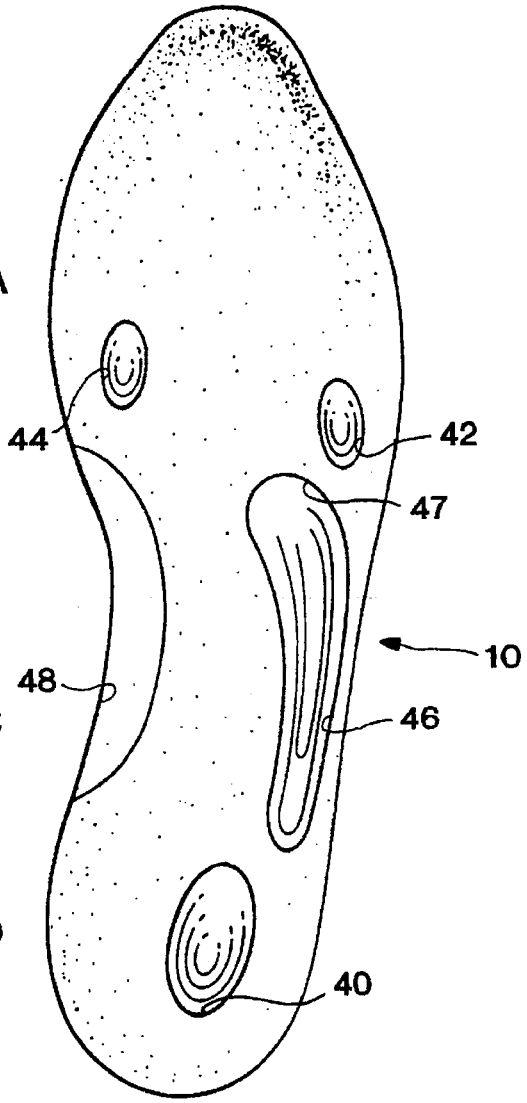
FIG. 10 is a bottom plan view of the outsole of the durable shock resistant shoe sole of FIG. 9.

Even more effective in a basketball or running environment, is the embodiment of the invention shown in FIGS. 9 and 10 of the drawings wherein the rear shock cup 40 is of an elliptical configuration angled with respect to axis and the two forefoot shock cups 42 and 44 are also of elliptical configuration and positioned to accommodate the first and fifth metatarsals. Situated intermediate the shock cups 40, 42 and 44 is a banana-shaped shock cup 46. Cup 46 is located along the lateral edge of the shoe sole. This banana-like shaped shock cup 46 is turned into the medial side at its front 47. In addition, the medial side can contain a scalloped portion 48 which is designed to reduce the weight of the shoe sole. As more and more cut-out portions are included within the shoe sole design of the present invention reinforcing means are generally incorporated within the shoe sole design of this invention to enable continued high strength to exist. The reinforcing means are described hereinbelow with respect to further other embodiments of the present invention.

Figure 11:
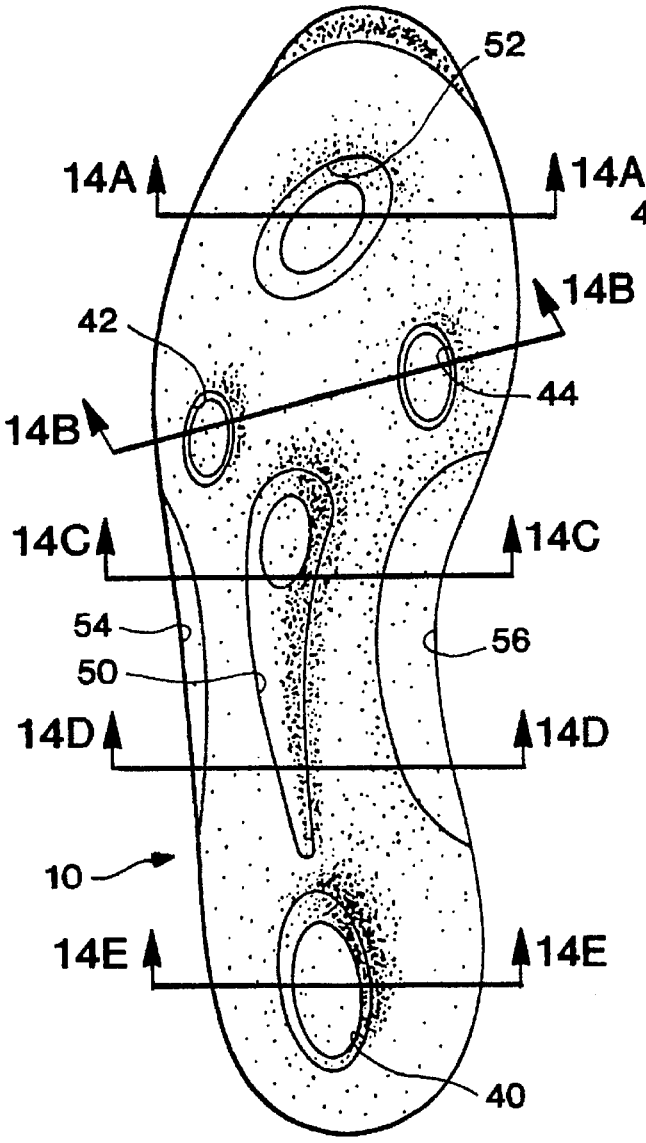
FIG. 11 is a top plan view of the midsole of the durable shock resistant shoe sole illustrating even further embodiments of this invention.
Figure 12:
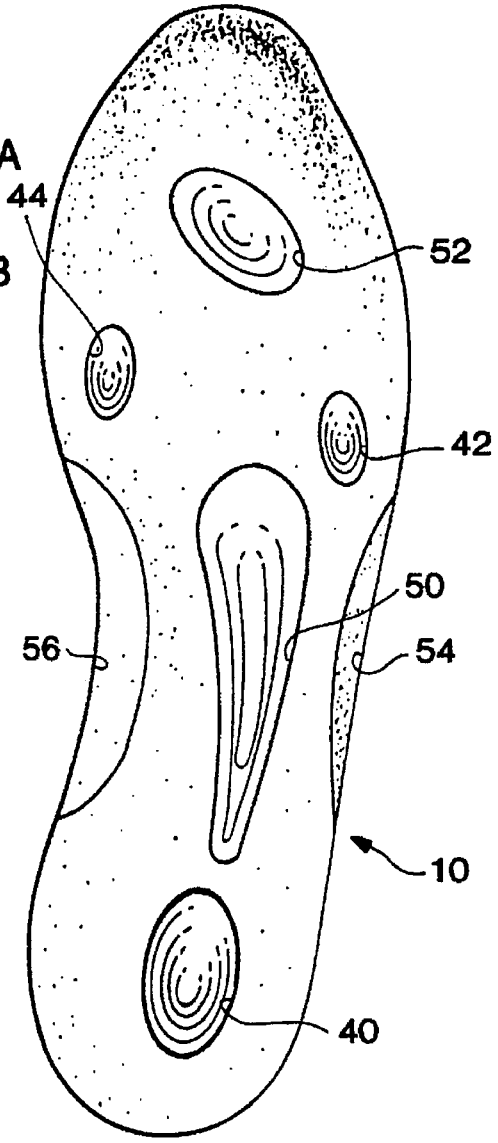
FIG. 12 is a bottom plan view of the outsole of the durable shock resistant shoe sole of FIG. 11.
Figure 14A:
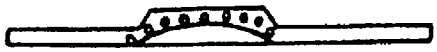
FIGS. 14 A–E represent cross-sectional views of the outsole of FIG. 11 taken along lines 14A—14A, 14B—14B, 14C—14C, 14D—14D and 14E—14E, respectively.
Figure 13A:
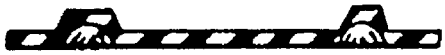
FIGS. 13 A–D represent cross-sectional views of the outsole of FIG. 9 taken along lines 13A—13A, 13B—13B, 13C—13C and 13D —13D and D—D, respectively.
Figure 14B:
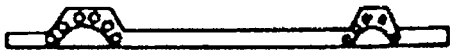
Figure 13B:
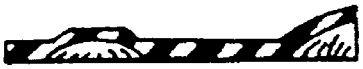
Figure 14C:
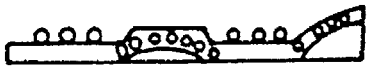
Figure 13C:
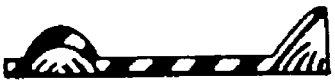
Figure 14D:
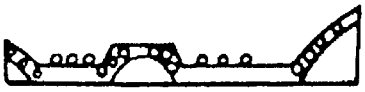
Figure 13D:
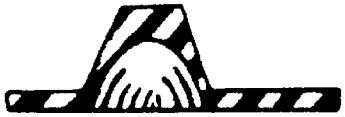
Figure 14E:
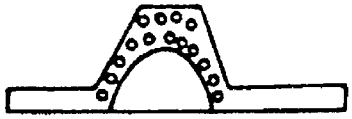

Reference is now made to FIGS. 11 and 12 of the drawings wherein a modified configuration of a basketball type shoe sole is illustrated and wherein the banana like shock cup 50 is located substantially within the center of the shoe sole and wherein a third forefoot shock cup 52 is located approximate the front end thereof. With the shock cup 50 located substantially along axis A, both the lateral and medial side of the shoe sole can have scalloped edges 54 and 56, respectively.

FIGS. 13A–13D and FIGS. 14A–14E represent cross sectional views taken along lines 13A—13A through 13D—13D of FIG. 9 and lines 14A—14A through 14E—14E of FIG. 11 respectively. These cross sectional views illustrate how the shock cups are inserted within the midsole region of the shoe sole. The modified configurations of the shock cups of the present invention substantially enhance the shock absorbing capability of the shoe sole of the present invention and therefore substantially enhances the use of the shoe sole.

Figure 15:
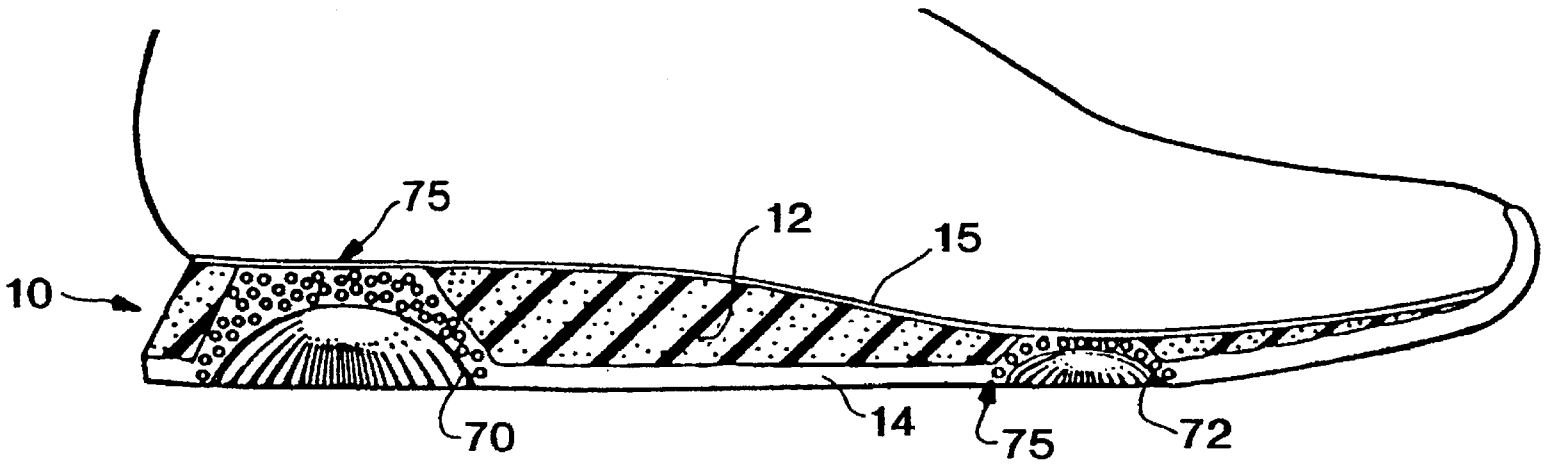
FIG. 15 is a side elevational view of the durable shock resistant shoe sole surrounding the shock cups.

Reference is now made to FIG. 15 of the drawings which illustrate in a cross-sectional view taken along axis of the sole illustrating a means of reinforcing the sole in order to strengthen not only the areas around the shock cups, but also the entire sole of the shoe. More specifically, FIG. 15 depicts the body or outsole 14, the midsole 12, the liner 15 as well as shock cups 70 and 72. As illustrated in FIG. 14, the reinforcing means can take the form of either a mesh net, belt or string made out of silicone or fiberglass and illustrated in FIG. 15 by numeral 75. The reinforcing means 75 in this embodiment of this invention are embedded within the outsole or bottom sole 14 and in the lateral direction of the sole 10. They surround the exterior of the shock cups 70 and 72 and are utilized to reinforce the shock cups and enhance their structural integrity thereby permitting the variety of different shapes of the cups and furthermore permit the removal of substantially more material in the form of scallops to make the sole lighter.

Figure 16:
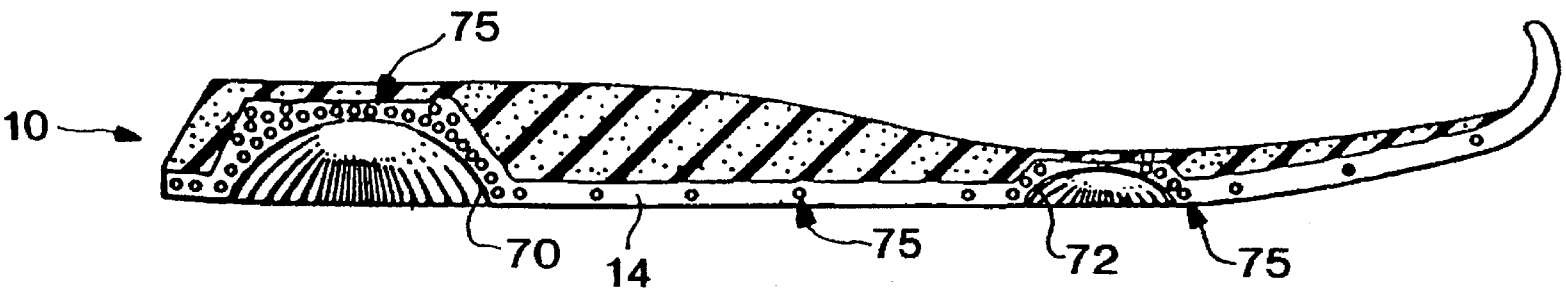
FIG. 16 is a cross-sectional view of the durable shock resistant shoe sole of the invention taken along the axis of the sole illustrating the reinforcing means in the outsole surrounding the shock cups and area therebetween.

In the embodiment of the shock resistant shoe sole 10 of the present invention as shown in FIG. 16 of the drawings, the reinforcing means 75 not only encompasses the shock cups 70 and 72, but also are embedded within the rubber outsole or bottom sole 14 along the base thereof. This additional reinforcing means, in the form of either strings or mesh net, add substantially to the structural integrity and support of the sole 10.

Figure 17:
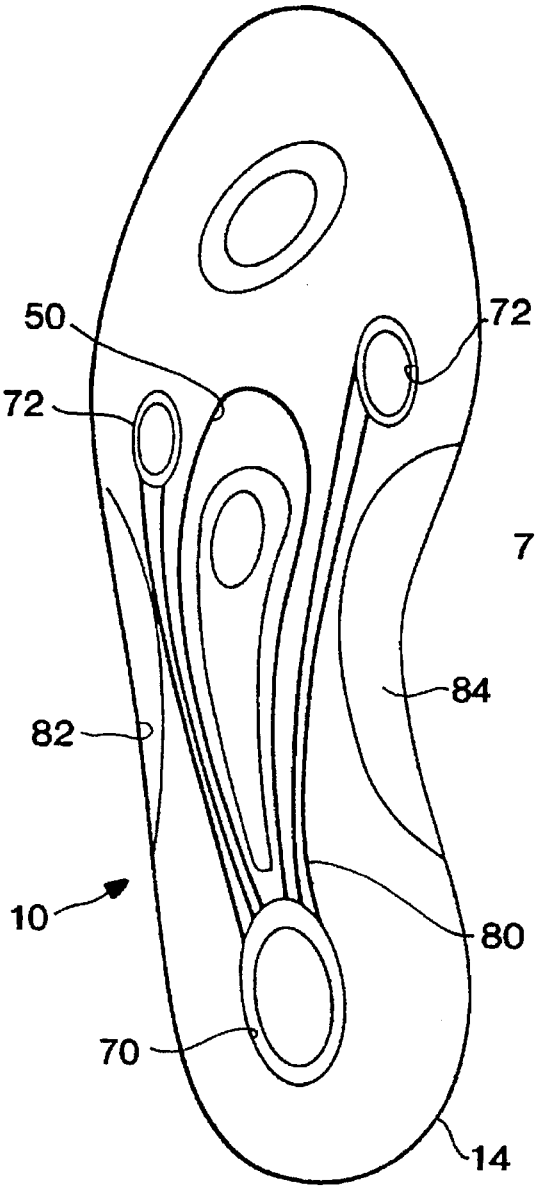
FIG. 17 is a top plan of the outsole of the durable shock resistant shoe sole of this invention illustrating the lengthwise reinforcing means.
Figure 18:
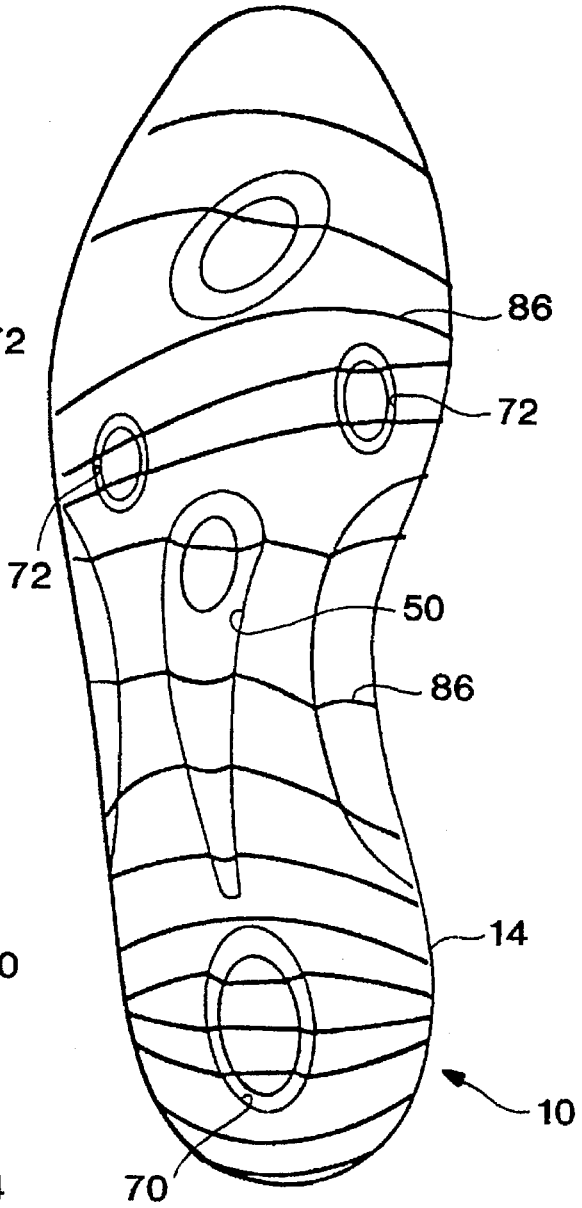
FIG. 18 is a top plan view of the outsole of the durable shock resistant shoe sole of this invention illustrating the lateral reinforcing means.

FIGS. 17 and 18 of the drawings represent top views of the outsole utilizing the strings or mesh net reinforcing means 75 as illustrated in FIGS. 15 and 16 of the drawings. More specifically, FIG. 17 represents the utilization of reinforcing means in the forms of strings 80 which run in the axial direction of outsole 14 and, as shown therein, are utilized to interconnect the shock cups 70 and 72. The arrangement shown in FIG. 18 of the drawings is extremely beneficial when used in conjunction with a banana-shaped shock cup 50. As a result of the increased removal of material within the outsole 14 additional reinforcing means add structural integrity to the shoe sole 10. As a result of this additional reinforcing means interconnecting the shock cups and running alongside the shock cups within the outsole 14 even further scalloping of the outsole 14 at 82 and 84 can take place thereby even further lighting the shoe.

FIG. 18 illustrates lateral strings 86 utilized as the reinforcing means and in which these strings run alongside the outer surface of the shock cups and are located, as with the reinforcing means of FIG. 17, within the outsole 14 of the shock resistant sole 10. It should further be realized that a combination of the reinforcing means utilizing the lateral strings 86 in conjunction with the axial strings 80 can further enhance the structural integrity of sole 10. The utilization of mesh net or strings of a material such as silicone, polyester or fibers which are embedded in the rubber of the outsole and placed around and over the shock cups causes substantial reinforcement or strengthening of the entire outsole by not only interconnecting the shock cups together but also reinforcing stability across the outsole laterally from the medial side across the shape of the foot.

Figure 19:
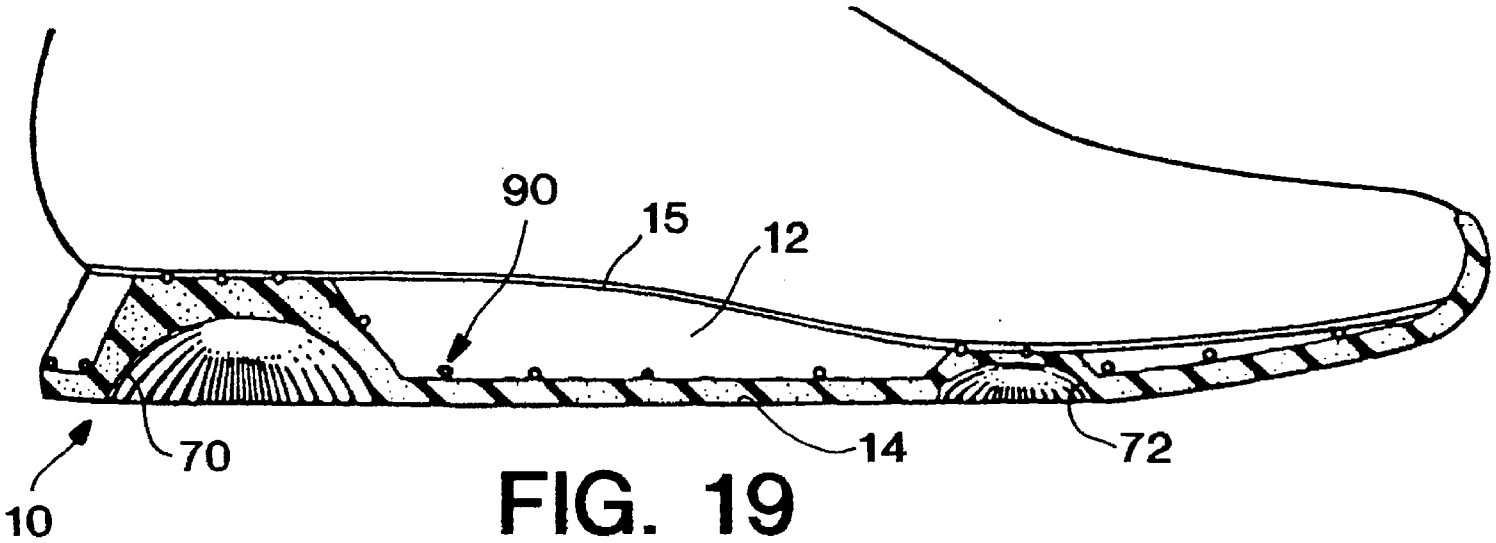
FIG. 19 is a cross-section side elevational view of the durable shock resistant shoe sole taken along the axis of the sole illustrating the reinforcing means being located between the midsole and the outsole.
Figure 20:
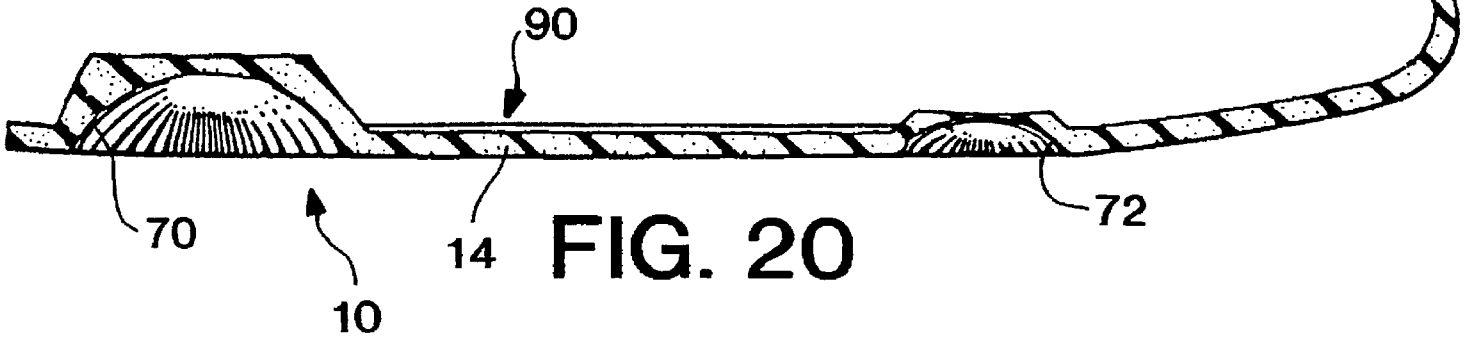
FIG. 20 is a durable shock resistant shoe sole illustrating the reinforcing means running lengthwise.

FIGS. 19 and 20 of the drawings represent cross-sectional views of an additional embodiments of this invention along the axis of the sole in which the reinforcing means 90, in the form of strings or mesh net, are located between the midsole 12 and the outsole 14. These strings or mesh net 90 can be situated within the shock resistant sole 10 of the present invention either in the lateral direction as illustrated in FIG. 19 of the drawings or in the axial direction as illustrated in FIG. 20 of the drawings. It should further be noted that it is also possible to utilize a combination of these configurations where the mesh net or string reinforcing means 90 intersect each other forming a reinforcing means over substantially the entire area between the midsole 12 and the outsole 14. This reinforcing means also substantially enhances the structural integrity of the shoe sole 10 of this invention.

Figure 21:
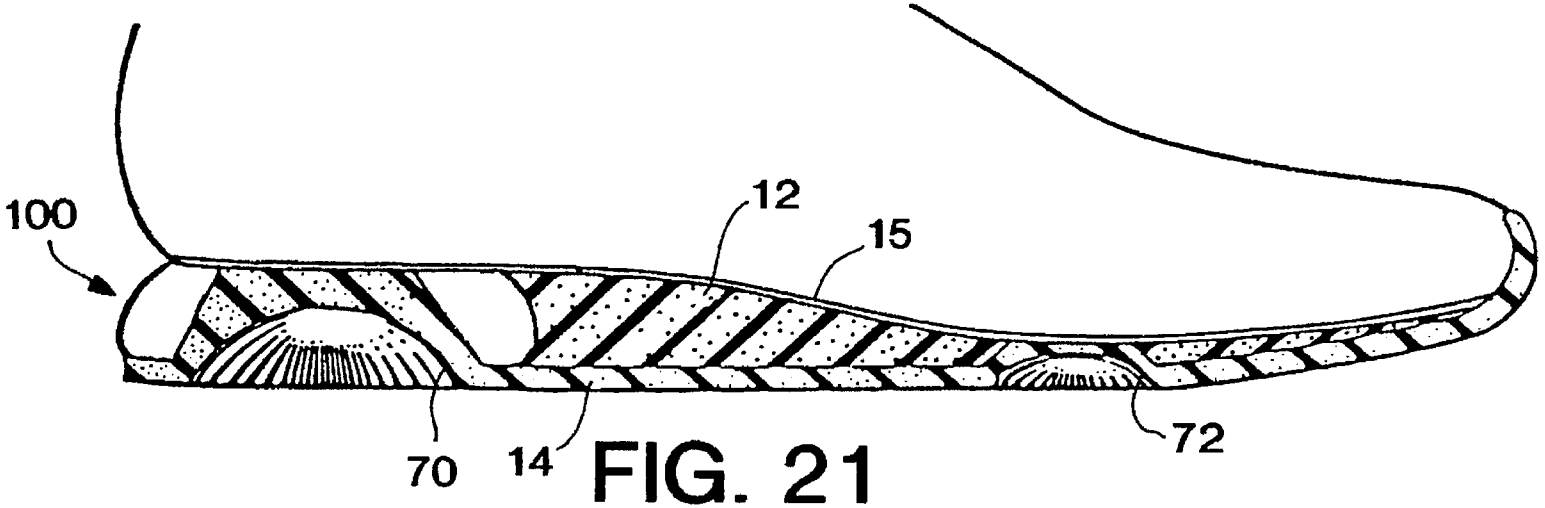
FIGS. 21 and 22 are cross-sectional side elevational views of the durable shock resistant shoe sole illustrating different embodiments of the transparent, doughnut-shaped support means.
Figure 22:
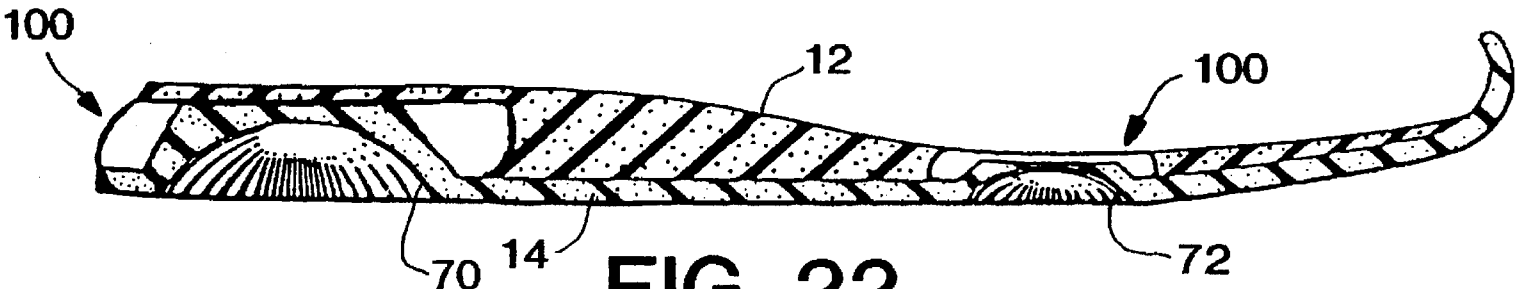

Reference is now made to FIGS. 21 and 22 of the drawings which illustrate in a cross-sectional view along the axis of the sole an alternative embodiment of a support structure which utilizes a transparent-doughnut shaped configuration 100 which encompasses the shock cups 70 or 72. The reinforcing means 100 depicted in FIGS. 21 and 22 are made of doughnut-shaped light weight plastic-like material which surround the shock cups about the outsole 14 in order to not only permit an observer to visualize the action which takes place during shock absorption by the shock cups of the present invention, but also to encompass the shock cups to add further rigidity and support to the cups. Since the material making up this reinforcing means 100 is lighter then the material it replaces, it also further adds to lessening the weight of the shock resistant sole 10 of the present invention. Additionally, the doughnut-shaped reinforcing means 100 can be filled with either air or a gas lighter then air such as helium to further compress the area around the shock cups to help support the shock cups and permit an even further structural reinforcement of the sole 10. FIG. 21 represents reinforcing means 100 filling the void between the outsole 14 and the liner of 15 while FIG. 22 illustrates the reinforcing means 100 located intermediate the midsole 12 and the outsole 14. By making these reinforcing means 100 transparent it will enable a consumer to visualize the shock cup operation both within the rear foot and forefoot windows. Further, by color coding the various components of the present invention, for example, utilizing a green color for the shock cups material and an orange color, for the mesh net or strings, and further by color coding the midsole, action of the shock resistant cups can be easily displayed through the transparent windows of the reinforcing means 100.

Figure 23:
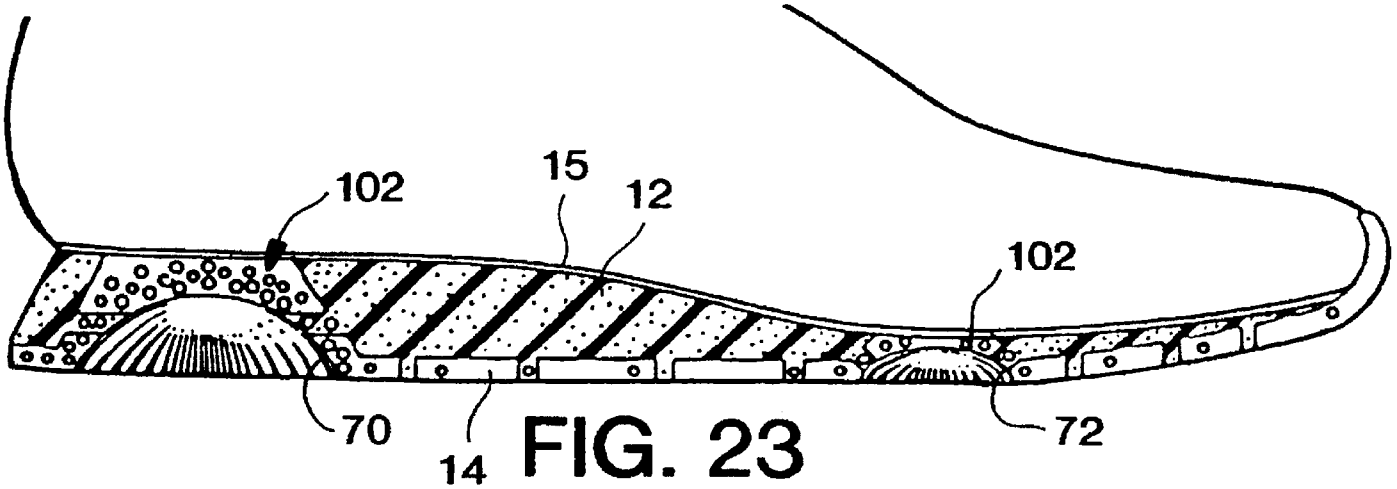
FIG. 23 is a cross-sectional side view of the durable shock resistant shoe sole illustrating the midsole material interfacing the shock cup and including reinforcing means.
Figure 24:
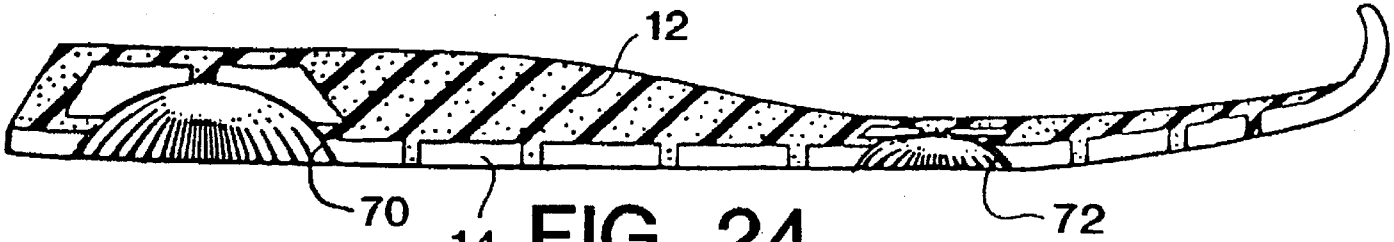
FIG. 24 is a cross-sectional side view of the durable shock resistant shoe sole without reinforcing means.

FIGS. 23 and 24 represent cross-sectional views of even a further embodiment of the present invention 10 taken along the axis A of sole 10 in which the midsole material 12 is passed through the shock cups in order to further aid in the reduction and the weight of the cups themselves. With increased reduction in the weight of the cups, it is even more desirable to also include therewith reinforcing means 102 in the form of either a mesh net or strings both in the lateral direction or axial direction such as explained in greater detail hereinabove. It should further be realized that this reinforcing means as shown in FIG. 23 of the drawings can be located within the outsole or bottom sole 14. Additional lightening of the sole material is made by the dispersion of the midsole 12 within the outsole 14. This lightening of the sole 10 of the present invention does not lessen the integrity of the sole 10 because of the continued use of reinforcing means therewith.

Although the invention has been described with reference to particular embodiments, it will be understood that this invention is also capable of further and other embodiments within the spirit and scope of the appended claims.

What is claimed is:

1. A durable, lightweight shock absorbing shoe sole comprising:

an upper sole having a thickness, said upper sole further defining an outline of a last bottom, said outline of said last bottom being representative of a shoe last used in the manufacture of said shoe, with a back portion of said outline establishing a back point of said outline of said last bottom, said upper sole also having a longitudinal axis being representative of a sole axis of said shoe sole, said sole axis running substantially through said shoe sole midpoint with its back point being said back point of said outline of said last bottom; and a bottom sole attached to the bottom of said upper sole and including an angularly displaced inverted cup dispersed therein, said inverted cup having a preselected shape defining a rear portion thereof and having a longitudinal axis, said inverted cup being located directly beneath and pointed convexly toward a natural contact point of the human foot for absorbing and dispersing shock generated at said natural contact point during a footstep, and said back point of said outline of said last bottom being located a distance away from said rear portion of said preselected shape, said longitudinal axis of said inverted cup being angularly displaced between approximately 6 and 15 degrees with respect to said sole axis, said angular displacement of said inverted cup with respect to said sole axis being measured from the intersection of said sole axis and said longitudinal axis of said inverted cup at said back point of said outline of said last bottom; and said inverted cup penetrating into the thickness of said upper sole to such a degree that said inverted cup absorbs substantially all of the shock at the natural contact point during a footstep.

2. A durable, lightweight shock absorbing shoe sole as defined in claim 1 comprising two inverted cups in addition to said angularly displaced inverted cup, said angularly displaced inverted cup located beneath the heel bone of the foot, and said two additional inverted cups located beneath associated metatarsals of the foot.

3. A durable, lightweight shock absorbing shoe sole as defined in claim 2 comprising at least one scalloped portion located in said bottom sole and positioned in the longitudinal direction in said bottom sole; and reinforcing means in cooperative relationship with said cups and said scalloped portion for increasing the structural integrity of the shoe sole.

4. A durable, lightweight shock absorbing shoe sole as defined in claim 3 wherein said reinforcing means comprises a mesh-like series of elements, said elements running in the longitudinal and lateral direction of the shoe sole.

5. A durable, lightweight shock absorbing shoe sole as defined in claim 4 wherein said reinforcing means further comprises a doughnut-shaped, transparent element encompassing said cup.

6. A durable, lightweight shock absorbing shoe sole as defined in claim 3 wherein said reinforcing means is located between said upper sole and said bottom sole.

7. A durable, lightweight shock absorbing shoe sole as defined in claim 3 wherein said reinforcing means comprises a doughnut-shaped, transparent element encompassing said angularly displaced inverted cup.

8. A durable, lightweight shock absorbing shoe sole as defined in claim 2 further comprising another inverted cup interposed between said two additional cups.

9. A durable, lightweight shock absorbing shoe sole as defined in claim 1 wherein said angularly displaced inverted cup is of an elliptical configuration.

10. A durable, lightweight shock absorbing shoe sole as defined in claim 1 wherein said angularly displaced inverted cup is of teardrop-like configuration.

11. A durable, lightweight shock absorbing shoe sole as defined in claim 1 comprising three inverted cups in addition to said angularly displaced inverted cup, said angularly displaced inverted cup located beneath the heel bone of the foot, two of said additional inverted cups located beneath associated metatarsals of the foot, and the third additional inverted cup being of an elongated, slightly curved configuration and located longitudinally between said angularly displaced inverted cup and said two additional inverted cups.

12. A durable, lightweight shock absorbing shoe sole as defined in claim 1, wherein the material of said upper sole is interspersed within said inverted cup.

* * * * *